United States Patent [19]

Schneider et al.

[11] 4,364,317

[45] Dec. 21, 1982

[54] MACHINE FOR SEWING TOGETHER WORKPIECE PARTS HAVING EDGES OF EQUAL OR UNEQUAL LENGTH BY MEANS OF A BEAD SEAM

[75] Inventors: Gerhard Schneider; Rolf Ludwig; Jochen Fischer, all of Bielefeld, Fed. Rep. of Germany

[73] Assignee: Kochs Adler AG, Bielefeld, Fed. Rep. of Germany

[21] Appl. No.: 161,905

[22] Filed: Jun. 23, 1980

Related U.S. Application Data

[62] Division of Ser. No. 875,417, Feb. 6, 1978, Pat. No. 4,274,345.

[51] Int. Cl.[3] ..... D05B 35/08

[52] U.S. Cl. ..... 112/132; 112/315; 112/323

[58] Field of Search ..... 112/132, 134, 135, 323, 112/315, 50–52, 147, 153, 311, 312, 313, 314, 303, 320

[56] References Cited

U.S. PATENT DOCUMENTS

| | | | |
|---|---|---|---|
| 563,471 | 7/1896 | French et al. | 112/51 |
| 1,071,026 | 8/1913 | Brogan | 112/51 |
| 1,800,409 | 4/1931 | Schuepbach | 112/132 |
| 2,331,318 | 10/1943 | Graham | 112/52 |
| 2,722,182 | 11/1955 | Quinn et al. | 112/51 |
| 2,755,753 | 7/1956 | Kratz et al. | 112/147 |
| 2,776,636 | 1/1957 | Seserman | 112/147 |
| 2,893,336 | 7/1959 | Chinnici | 112/132 |
| 2,962,991 | 12/1960 | Burgert | 112/132 |
| 3,000,332 | 9/1961 | Sigoda | 112/132 |

*Primary Examiner*—H. Hampton Hunter
*Attorney, Agent, or Firm*—Max Fogiel

[57] ABSTRACT

A machine for sewing together two workpiece parts having edges of equal or unequal length by using a bead seam, especially for joining together the edge of a vamp and the shorter edge of a plug of a true moccasin shoe, so that the length of the plug matches that of the longer edge of the vamp, in only one operation. The bead seam forming device essentially consists of an auxiliary folding and ruffling finger acting in front of the needle of the sewing machine and in synchronous driving connection with the needle; several machines are described which are provided with different bead seam forming devices.

14 Claims, 35 Drawing Figures

Fig. 5
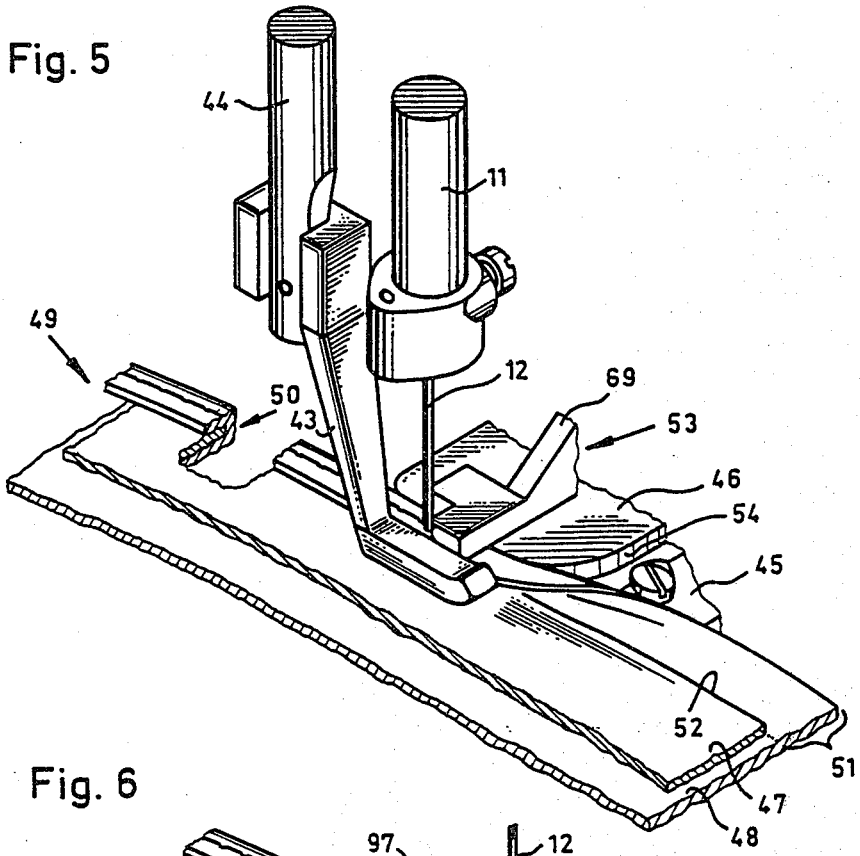
Fig. 6
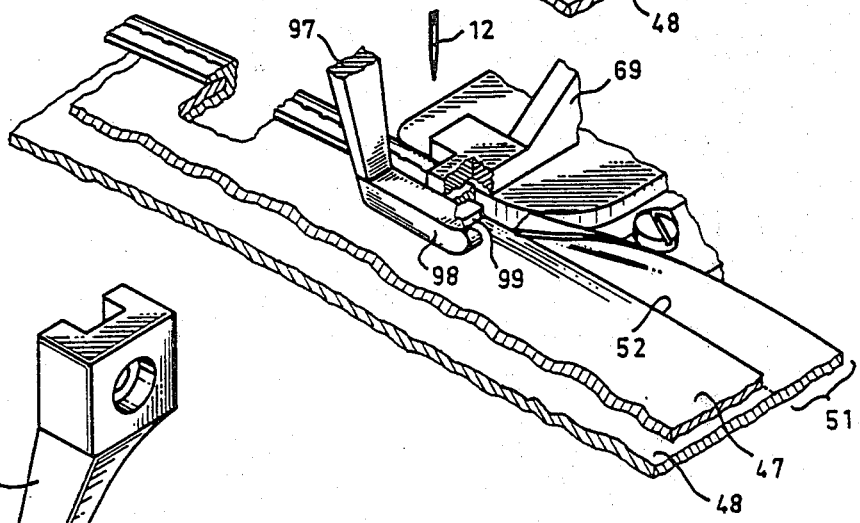
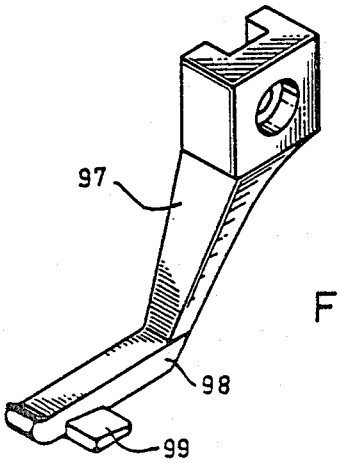
Fig. 7

Fig. 13
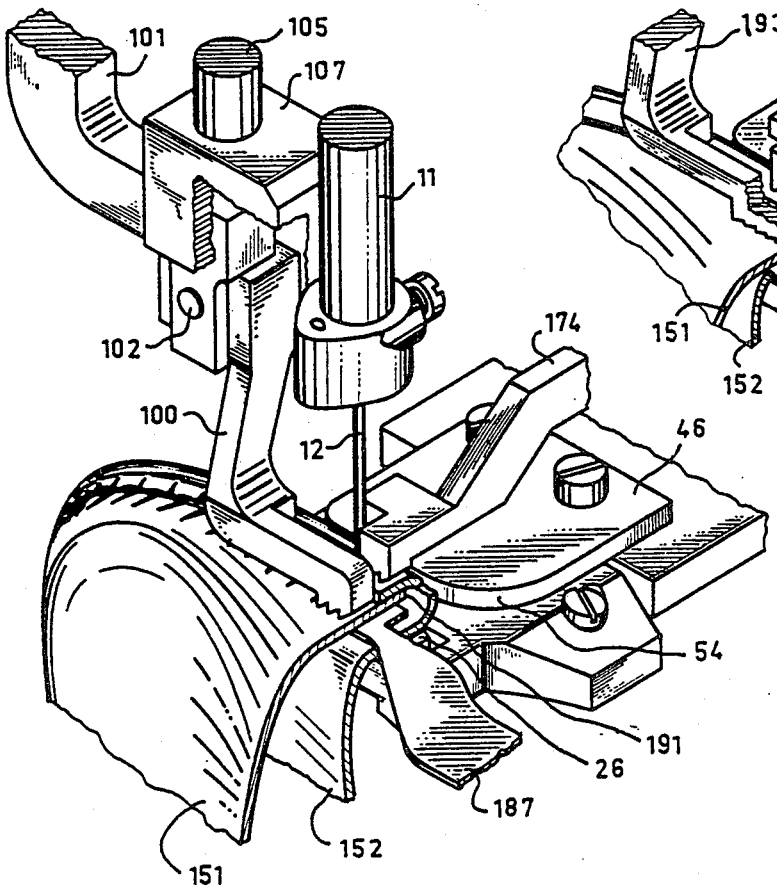
Fig. 14
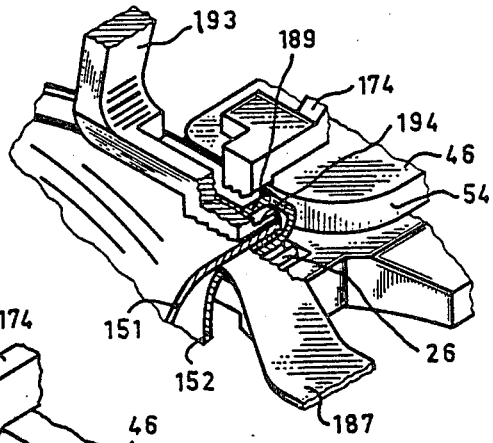
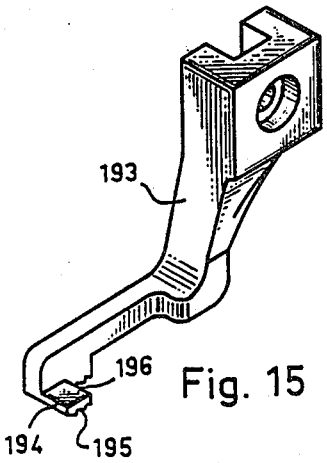
Fig. 15
Fig. 9
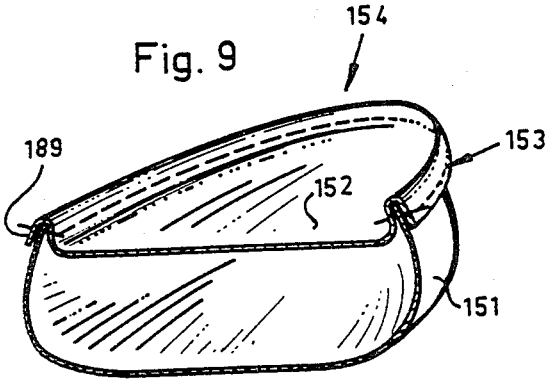
Fig. 8
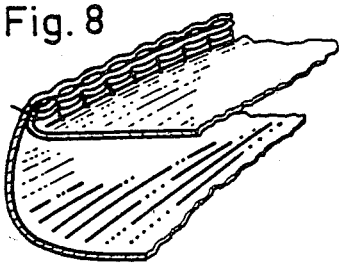

Fig.16
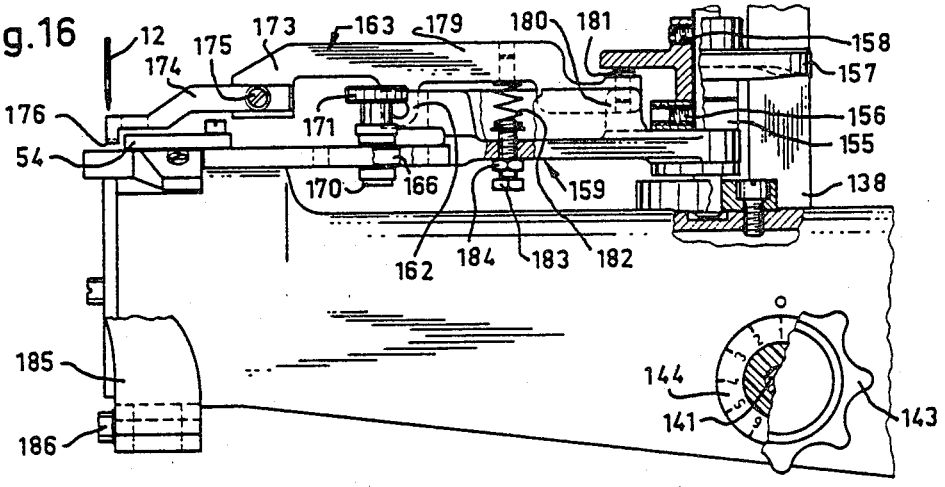
Fig.17
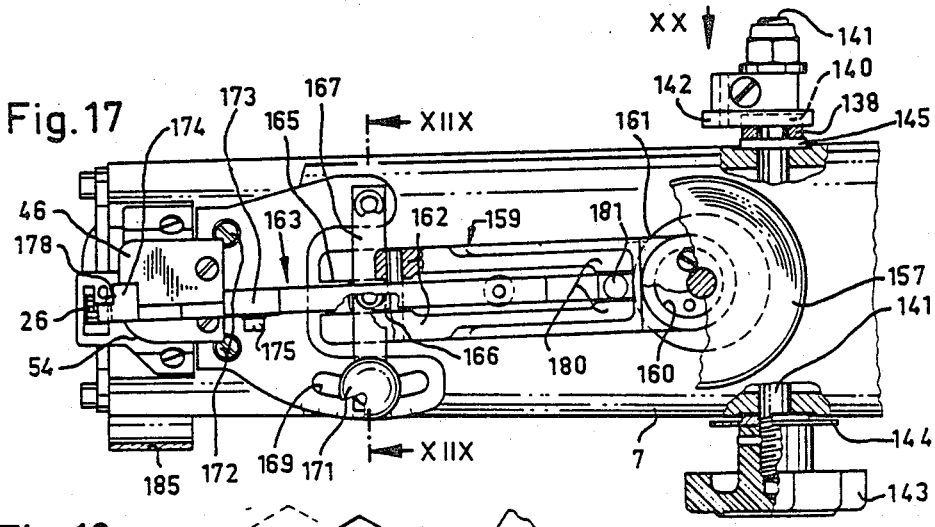
Fig.19
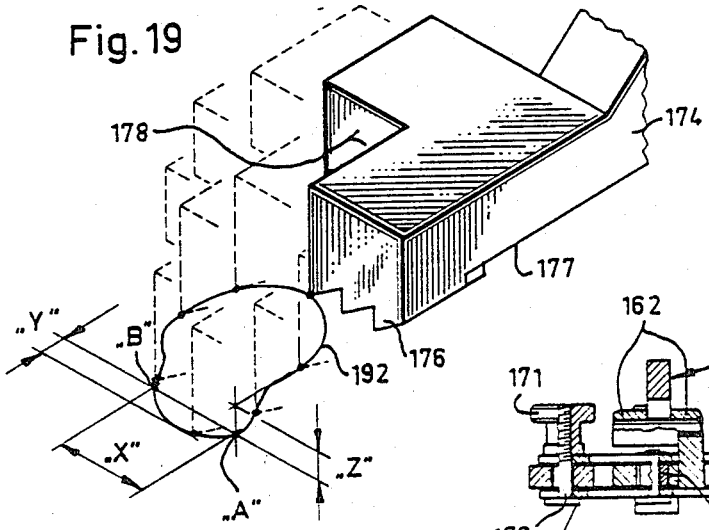
Fig. 20
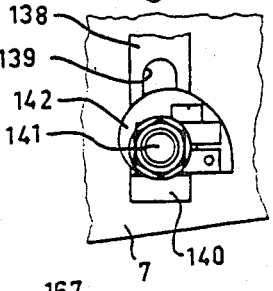
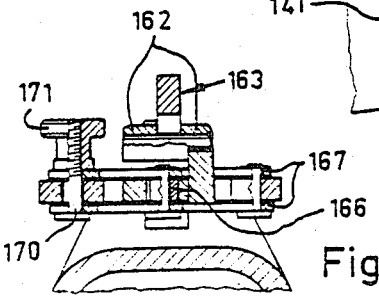
Fig.18

Fig. 25
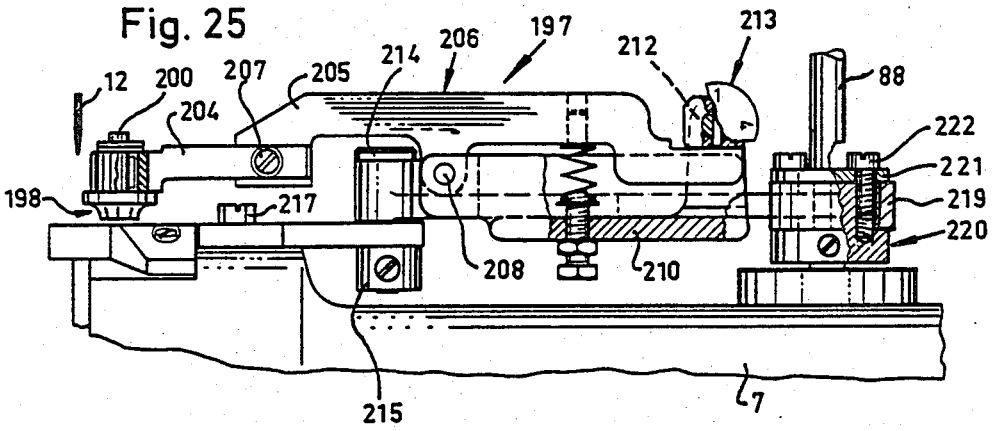
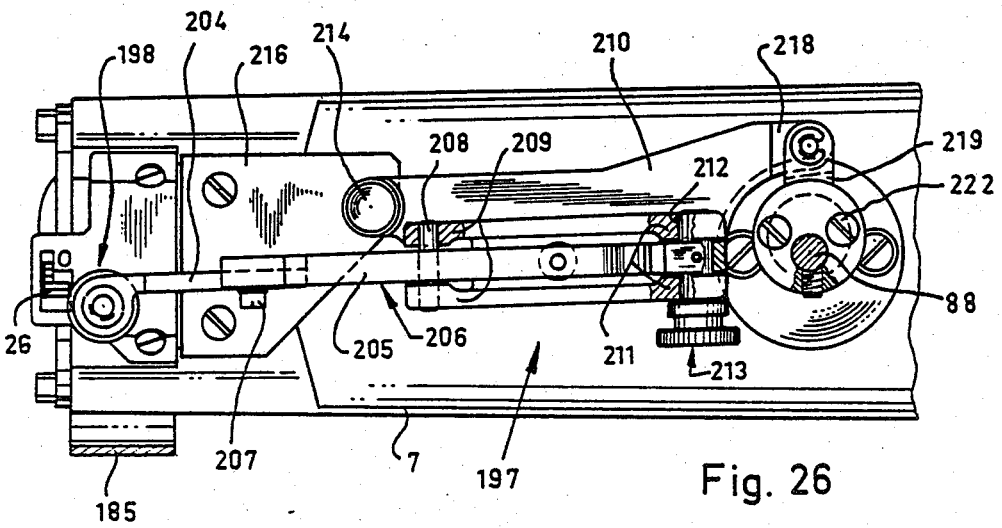
Fig. 26
Fig. 27
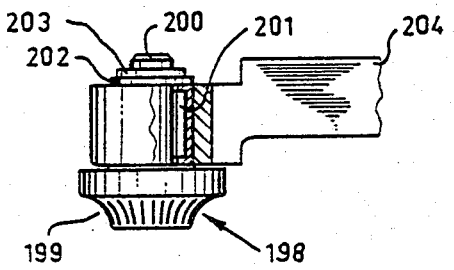
Fig. 28
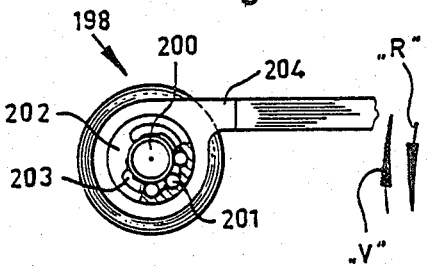

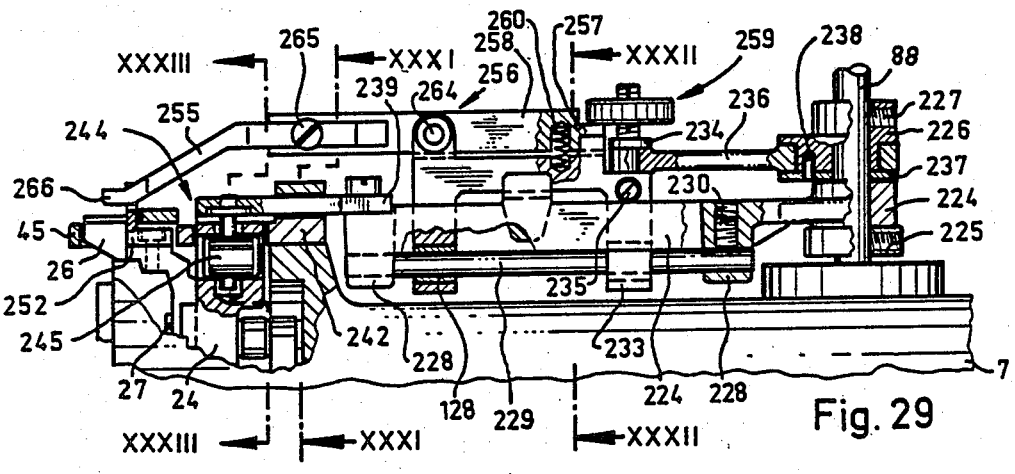
Fig. 29
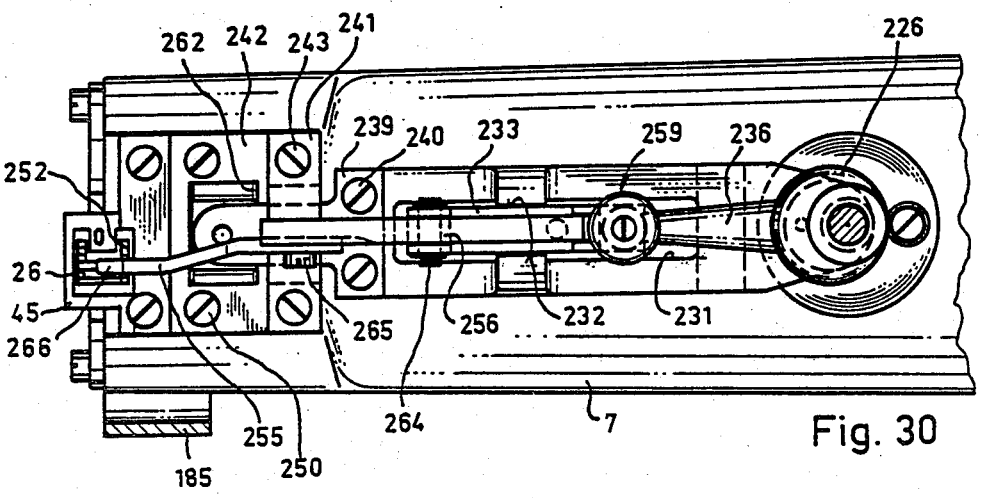
Fig. 30
Fig. 32
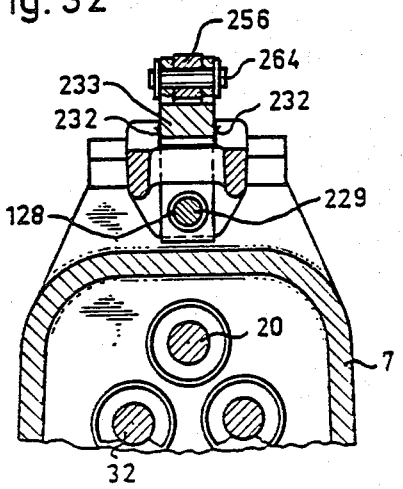
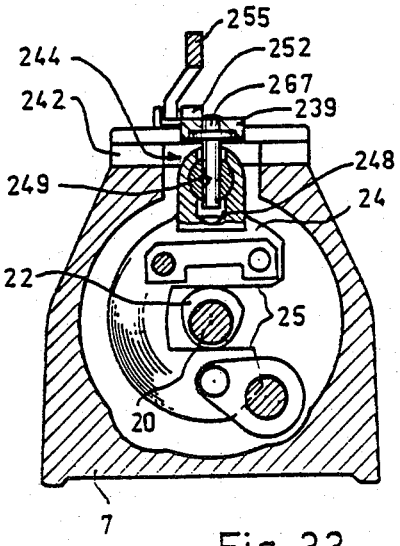
Fig. 33

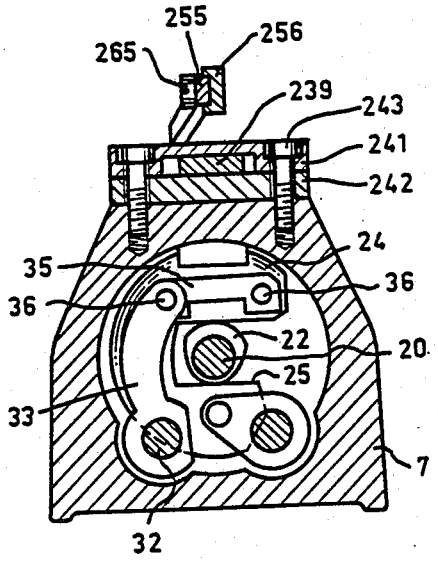
Fig. 31
Fig. 34
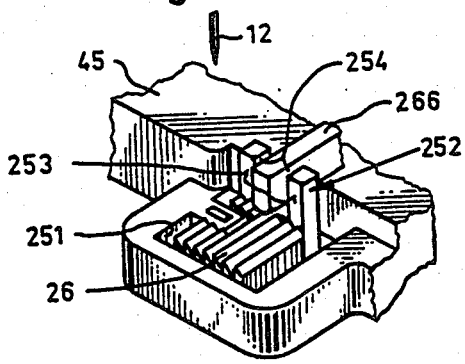
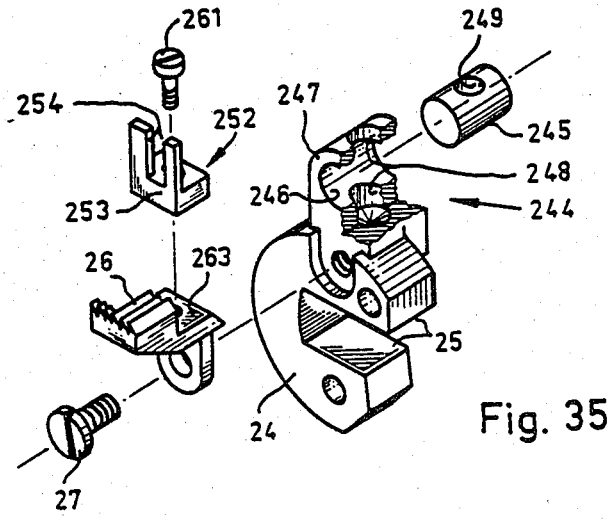
Fig. 35

MACHINE FOR SEWING TOGETHER WORKPIECE PARTS HAVING EDGES OF EQUAL OR UNEQUAL LENGTH BY MEANS OF A BEAD SEAM

This is a division of application Ser. No. 875,417 filed Feb. 6, 1978 and now U.S. Pat. No. 4,274,345, dated June 23, 1981.

BACKGROUND OF THE INVENTION

The present invention generally relates to improvements in sewing machines, in order to sew together workpiece parts having edges of equal or unequal length by means of a bead seam, and to improvements in so-called heavy-duty sewing machines intended to handle tough materials, such as leather. Especially, this invention relates to improvements in such sewing machines, which are intended to sew the edge of a plug to that of a vamp of a true moccasin shoe, while causing the longer edge of the vamp to be ruffled so as to match the edge length of the plug.

A 'true moccasin' means a shoe, in which the vamp, a part of the upper, underlies the wearer's foot particularly in the toe area and is joined by a seam to a toe covering plug.

Conventionally, moccasin shoes are manufactured with a hand sewn seam; however, as described in the U.S. Pat. No. 3,530,808, filed June 2, 1969, that is a very expensive and tedious time consuming process requiring considerable skill of the operator. For this reason, many attempts have been made to develop a machine for processing moccasins which, in particular, is adapted to form a seam joining the outer edge of a plug to that of a vamp of a moccasin, while the much greater peripheral length of the vamp is puckered to coincide with the smaller peripheral length of the plug. It is a characteristical feature of the above-mentioned U.S. patent to provide a lockstitch sewing machine having two adjustable workpiece feeding devices, with means for imparting longitudinal work compressing motions to the vamp, whereby portions of the margin of the vamp are joined to the margin of the plug by stitches in puckered relationship. However, the range of application of the invention according to the aforesaid U.S. patent is limited to a so-called open edge ruffling seam. Since this type of seam is not waterproof, applicability is only limited to cheap moccasin footwear. Therefore, high quality mocassin shoes are fabricated with a bead seam formed by the protruding edge of the plug which is rolled over the edge of the vamp and stitched to the vamp and the plug.

In order to meet the requirements of the shoe industry for giving a machine manufactured moccasin shoe a hand sewn appearance, a new method using three sewing machines for producing moccasin shoes having the desired comfort factor and hand sewn appearance and achieving an increase of efficiency was published in the "DNZ-magazine No. 4/1977". This published method comprises the following steps:

(a) A first sewing machine automatically ruffles the peripheral length of the vamp, at which the amount of ruffling and the position of ruffling are adjustable by means of a preselector, or mechanically. Simultaneously, a tape is stitched to the vamp for fixing the ruffles.

(b) Stitching of the plug to the vamp on a post-type sewing machine, and (c) final stitching with threads up to 0.6 mm and simultaneously rolling the protruding edge of the plug over the edge of the vamp for forming a bead seam.

According to a method published in an applicant's pamphlet, only two special purpose sewing machines for producing genuine moccasins and ruffling work on shoes are required. The first sewing machine is provided with a device for ruffling the vamp and simultaneously stitching the plug, with a metal plate (blade) located between the plug and the vamp for separating both parts for allowing ruffling. The second sewing machine stitches the bead seam with a coarse thread as the protruding edge of the plug is manually rolled over the edge of the vamp.

The aforesaid methods include three or two steps for joining the vamp and the plug. In the first method two auxiliary seams and in the second method one auxiliary seam are necessary for preparing the leather cuts prior to final joining by means of a lockstitch seam formed by coarse threads. Besides the fact that the auxiliary threads cannot be invisibly covered by this lockstitch seam, stitching of three- respectively two-step-sequence causes an additional perforation in the material and a considerable weakness of the seam results.

SUMMARY OF THE INVENTION

It is an object of the present invention to provide a sewing machine having stitch forming instrumentalities, workpiece feeding means, a workpiece press pad and an edge guide for the workpiece with means for forming a bead seam during sewing together an edge of a first layer to a second layer having a protruding edge allowing the forming of the bead seam. For sewing together two layers of relatively tough materials, such as light leather, this object of the invention is achieved by providing a forming edge at the edge guide for prefolding the protruding edge of the second layer and a driven folding means which operates in an area in front of the needle and in synchronism with the same, for folding the protruding edge about the edge of the first layer and imparting motions to the protruding edge in the direction of the needle. In order to use more pliable leather, an intermediate member may be arranged above the first layer and in front of the needle. According to a further feature of the invention, the press pad is provided with a tongue, in order to serve as an intermediate member and arranged in front of the needle between the first layer and the folded protruding edge.

Another object of the present invention is to provide a sewing machine for sewing together a first layer having a relatively long edge with a second layer having a relatively short edge, in which the first layer is adjustably ruffled during sewing so as to match with the length of the shorter second layer, in such a way, that the second layer having a protruding edge will be formed into a bead seam.

Another important object of the present invention is to provide a sewing machine adapted for joining the edge of a moccasin vamp to that of a moccasin plug with a seam while the vamp is ruffled in order to match its edge to that of a plug, and simultaneously a bead seam is formed.

It is the main object of the present invention to reduce the high cost of manufacturing shoes of the moccasin-type caused by the conventional handmade methods or by the above-mentioned mechanical methods needing two or three sewing machines especially when sewing together the vamp and the plug by means of a bead seam.

The foregoing is realized in a sewing machine for sewing together a vamp and a plug which is provided with stitch forming instrumentalities, an edge guide for guiding the vamp and the plug having a protruding edge and prefolding this edge, feeding means for the plug, adjusting means for the feeding means for the plug, for determining the stitch length, feeding means for imparting longitudinal work compressing motions to the vamp and an intermediate member between the feeding means for the plug and the feeding means for the vamp, for preventing a ruffling of the plug by the feeding mechanism for the vamp.

According to a feature of the invention, this sewing machine is provided with a driven auxiliary ruffle means arranged in front of the needle of the sewing machine, for folding the prefolded protruding edge of the plug about the edge of the vamp and for imparting longitudinal work compressing motions to the folded dege of the plug prior to sewing together the three layers of material by means of only one seam.

A further object of this invention is to positively feed the ruffled portion of the vamp and to prevent a deflection of the ruffles caused by the friction between the vamp and the folded edge of the plug.

The foregoing object is achieved by providing a second intermediate member which is located between the vamp and the folded protruding edge of the plug and in front of the needle.

According to a further feature of the invention, in which the feeding means for imparting longitudinal work compressing motions to the vamp consist of a feed dog operating in a four motion path adjacent and opposite to the needle and the edge guide, the second intermediate member having a sliding surface is a part of the feed dog and located between the vamp and the folded protruding edge of the plug in front of the needle, and the feed dog and the second intermediate member are provided with teeth for engaging the upper surface of the vamp.

In a preferred embodiment, the auxiliary ruffle means for folding the prefolded protruding edge of the plug about the edge of the vamp and imparting longitudinal work compressing motions to the folded edge of the plug comprises a ruffle finger provided with teeth arranged at the underside of the finger and perpendicularly to the feed direction of the vamp and the plug and a cutaway portion for the needle, and a control mechanism for imparting tridimensional ellipse-shaped motions to the ruffle finger in synchronism with the movement of the needle.

In the preferred embodiment of the invention, the control mechanism includes a two-armed lever, one arm of which carries the ruffle finger, a vertical shaft pivoted in the supporting arm and the bracket arm of the sewing machine and a driving connection with the arm shaft, an eccentric which is secured to the vertical shaft, a carrier which is provided with a bearing for receiving the two-armed lever, a hole at one end of the carrier for receiving the eccentric which imparts ellipse-shaped motions to the ruffle finger, and pivotal means at the other end of the carrier, a cam follower arranged on the other arm of the two-armed lever, a cam disk cooperating with the cam follower for imparting up and down motions to the ruffle finger, and spring means between the carrier and the other arm of the two-armed lever, for pressing down the ruffle finger in the direction to the protruding edge of the plug. Furthermore, there is provided an adjusting means for varying the elliptical path of motion of the ruffle finger.

According to a modified feature of the invention, the auxiliary ruffle means arranged in front of the needle comprises a ruffle and folding finger which is provided with a plain underside, a run-on edge in feed direction and a cutaway portion for the needle, and a control mechanism provided for imparting ellipse-shaped motions to the ruffle and folding finger in synchronism with the movement of the needle, including spring means for pressing down the ruffle and folding finger in the direction to the protruding edge of the plug, adjusting means for varying the tension of the spring and adjusting means for varying the position in vertical sense of the ruffle and folding finger.

According to still another feature of the invention, the machine for sewing together true moccasin shoe parts including a vamp and a plug, is provided with means for forming a bead seam by means of a plug having a foldable margin which protrudes over the edge of the vamp, comprises a roller provided with a knurled profile fitted for folding the protruding margin about the edge of the vamp and the intermediate member prior to sewing and an overrunning for allowing rotation of the roller only in one direction, a rocking lever pivotally mounted and carrying the roller, and driving means for moving the rocking lever which carries the roller, in synchronism with the stitch forming means of the sewing machine, in order to impart work compressing motions to the margin of the plug by the roller, when the overrunning is blocked and to prefold the margin when the roller is unblocked.

Other objects, features and advantages of the invention will be described in connection with the drawings and the appended claims.

BRIEF DESCRIPTION OF THE DRAWINGS

FIG. 5 is a perspective top plan view of the workpiece layers and tools of the sewing machine for joining together the layers by means of a bead seam without ruffling of one of the layers;

FIG. 6 is a perspective top plan view similar to FIG. 5, however, with a modified presser foot;

FIG. 7 shows the presser foot of FIG. 6 in a perspective top plan view;

FIG. 8 is a fragmentary perspective view of a vamp and a plug of a true moccasin-type shoe, which have been joined together by an open edge ruffling seam;

FIG. 9 is a fragmentary perspective view of a cut-off of a true moccasin-type shoe, in which the vamp is ruffled and joined with the plug by means of a bead seam;

FIG. 13 is a partial front view in perspective as seen from a direction above, with the upper feed dog and other mechanism shown in FIGS. 10 to 12;

FIG. 14 is a partial similar view as shown in FIG. 13, however, with a modified upper feed dog;

FIG. 15 shows the modified upper feed dog corresponding to FIG. 14, in a perspective side elevation;

FIG. 16 is a front elevation of the sewing machine showing a portion of the work supporting arm and the preferred embodiment of an auxiliary ruffle and bead seam folding device;

FIG. 17 is a top plan view of the work supporting arm corresponding to FIG. 16;

FIG. 18 is a partly cross-section taken along the line XIIX—XIIX of FIG. 17;

FIG. 19 is an enlarged portion of the auxiliary ruffle finger and shows the path of motion of the finger;

FIG. 20 is a rear elevation of the work supporting arm corresponding to the arrow XX in FIG. 17, and shows an adjusting member for the upper feed dog;

FIG. 25 shows in a front view still another modified auxiliary ruffle and bead seam folding device;

FIG. 26 is a top plan view of the work supporting arm corresponding to FIG. 25;

FIG. 27 is an enlarged front end view of the ruffle finger in form of a roller having an overrunning, shown in FIG. 25;

FIG. 28 is a top plan view of the roller corresponding to FIG. 27;

FIG. 29 is a front view of a further modified auxiliary ruffle and bead seam folding device;

FIG. 30 shows a top plan view of the work supporting arm corresponding to FIG. 21;

FIG. 31 is a vertical section taken along line XXXI—XXXI of FIG. 29;

FIG. 32 is a vertical section taken along line XXXII—XXXII of FIG. 29;

FIG. 33 is a vertical section taken along line XXXIII—XXXIII of FIG. 29;

FIG. 34 is a partial front top view in perspective, in an enlarged scale showing a portion of the ruffle and bead seam folding device; and FIG. 35 is an exploded perspective view of the feed dog carrier with coupling parts and workpiece handling parts.

DESCRIPTION OF THE PREFERRED AND MODIFIED EMBODIMENTS

Figure 1:
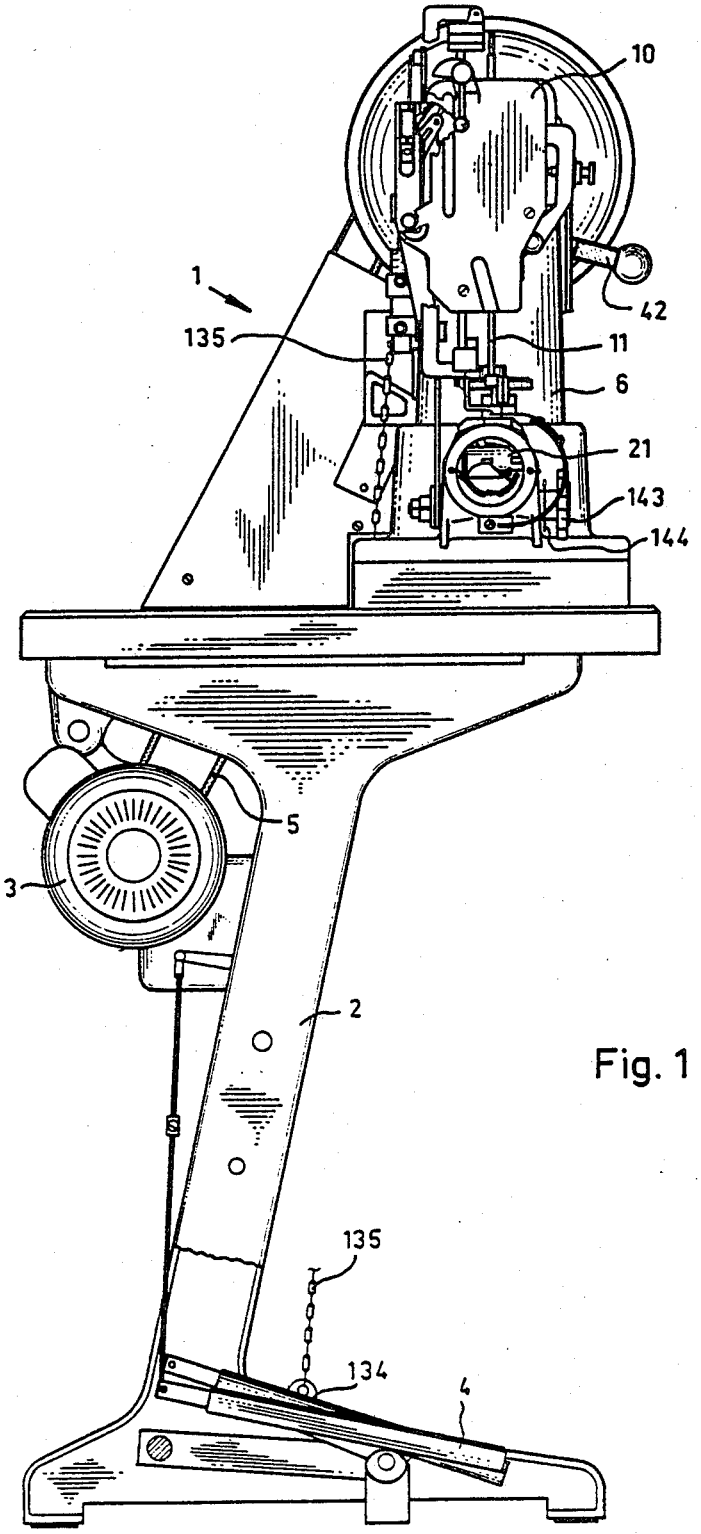
FIG. 1 is a left side elevation of a stand and a sewing machine incorporating a preferred embodiment of the present invention.
Figure 2:
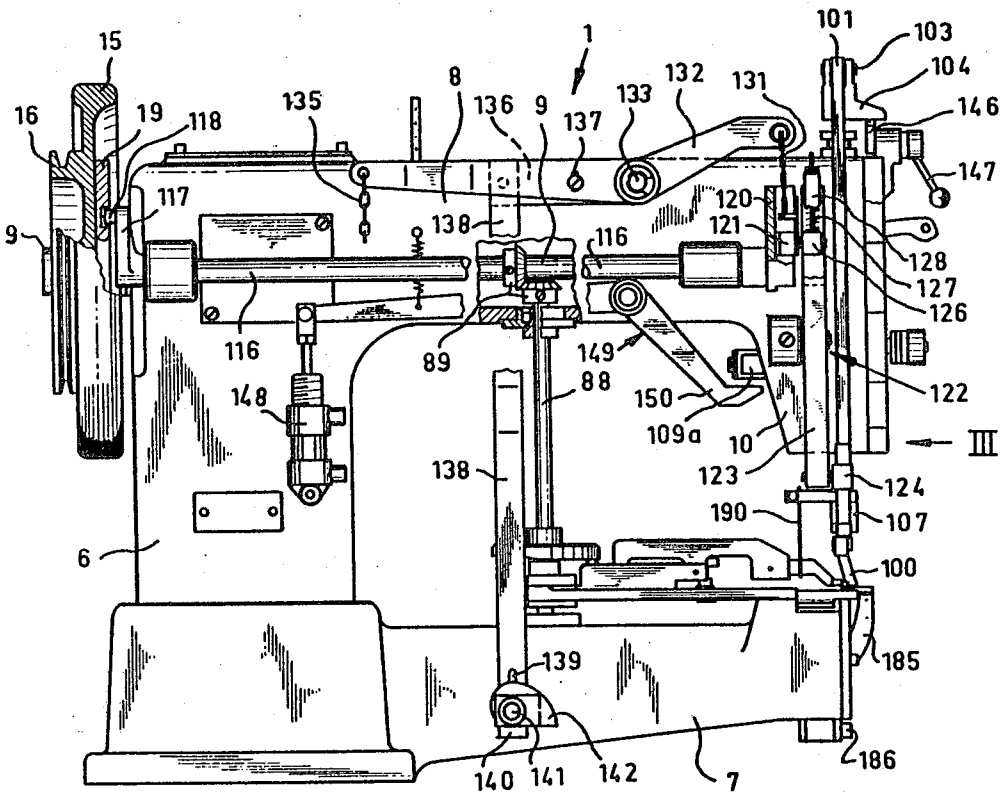
FIG. 2 is a rear elevation of the sewing machine shown in FIG. 1.
Figure 3:
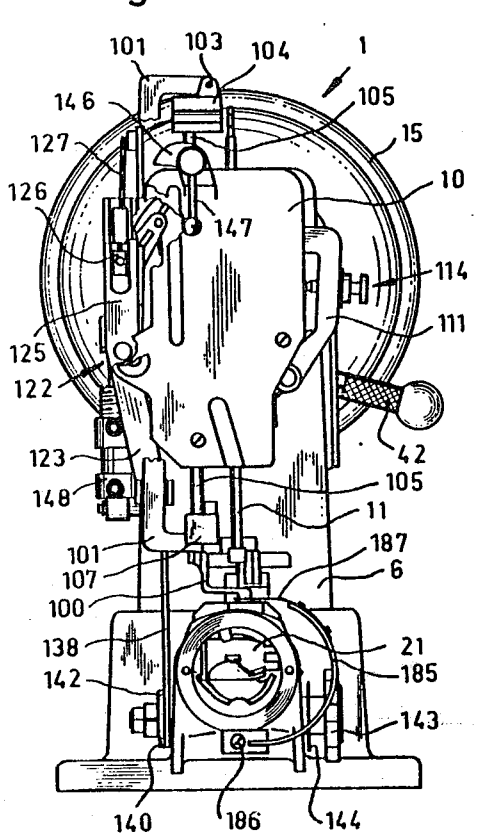
FIG. 3 shows the sewing machine in a view in direction of arrow III in FIG. 2.

Referring more particularly to the several figures of the drawings it will be noted, that the sewing machine used with this invention, is a so-called "coarse stitch arm type sewing machine for ruffled work and genuine moccasins" of the assignee classified with "Alder 105-RM25/Sp 75" and generally designated with 1 in FIGS. 1, 2 and 3.

Figure 4:
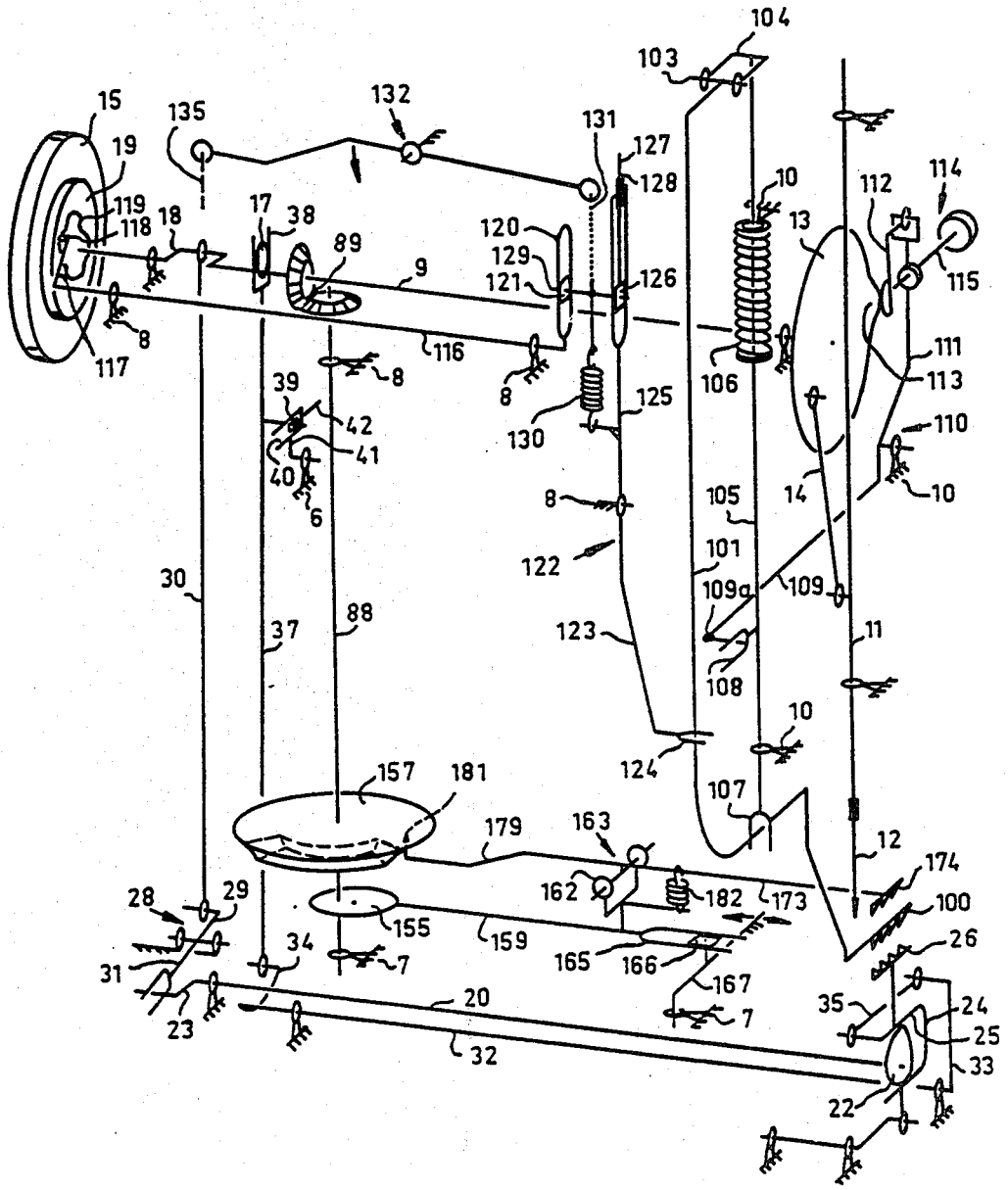
FIG. 4 is a schematic rear elevation of the essential inside parts of the sewing machine and parts of the mechanism according to the invention.
Figure 10:
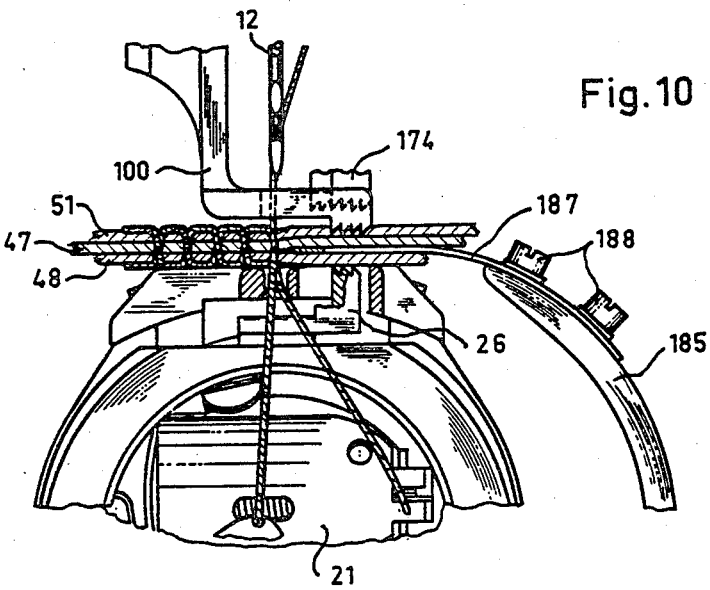
FIG. 10 is an enlarged partial view of FIG. 3 showing portions of the feeding devices and stitch forming instrumentalities and their relative action upon the several workpiece layers to be stitched together by a bead seam.
Figure 11:
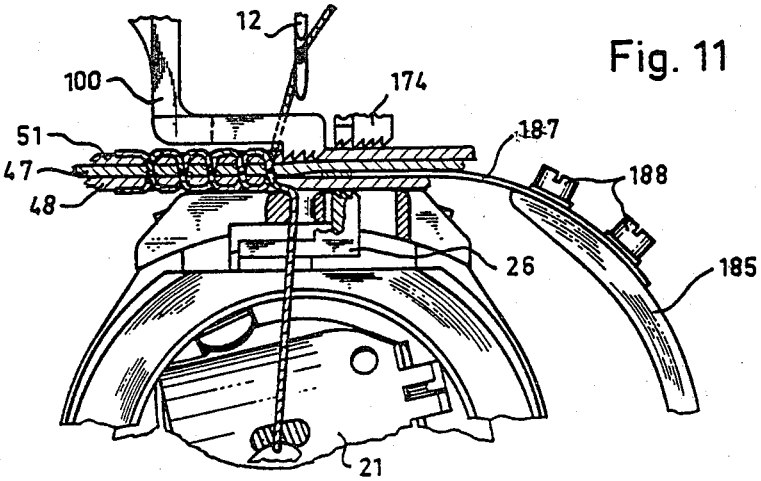
FIGS. 11 and 12 are similar views as shown in FIG. 10, the devices of which are in other operative positions.
Figure 12:
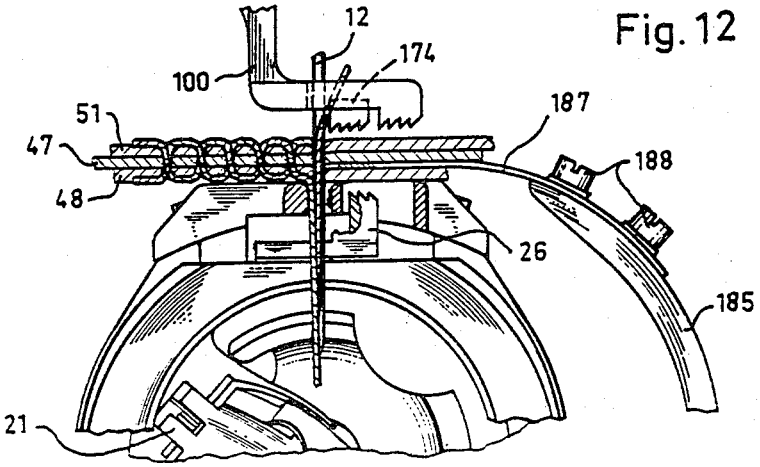

The sewing machine 1 mounted on a stand 2, which carries a driving motor 3 actuated by a treadle 4 and in driving connection with the sewing machine 1 by means of a belt 5, includes, as evident from FIGS. 1 to 3 and 10 to 12, a stand 6, a work supporting arm 7 extending from the stand 6, a bracket arm 8 carrying an arm shaft 9 and ending in a sewing head 10. Under consideration of the schematic rear elevation of the essential inside parts as shown in FIG. 4, the sewing machine 1 further comprises a needle bar 11 carrying a thread-guiding needle 12, and is driven by a crank drive mechanism, which includes a crank 13 and a link 14. The arm shaft 9 carries the usual flywheel 15, a grooved belt pulley 16, an eccentric disk 17, a cam plate 19, and is provided with a crank 18.

Within the supporting arm 7 there is pivoted a hook shaft 20, which carries a looptaker 21 (in FIGS. 1, 3 and 10, 11, 12 a barrel shuttle), a lifting eccentric 22 (FIGS. 4, 31) and a crank 23 (FIG. 1). The lifting eccentric 22 is received in a forked portion 25 of a feed dog carrier 24 (FIGS. 10 to 12 and 29, 30), to which is secured a toothed feed dog 26 by means of a screw 27 (FIG. 29). As shown in FIG. 4, a two-armed lever 28 is pivotally mounted in the supporting arm 7. One arm 29 of the two-armed lever 28 is connected by means of a link 30 to the crank 18 of the arm shaft 9, the other forked arm 31 is linked to the crank 23.

A feed shaft 32 pivotally mounted in the supporting arm 7, is provided at its end with a crank 34. A link 35 is pivoted to the crank 33 and the feed dog carrier 24 by means of pins 36 (FIG. 31). Linked to the crank 34 is a connecting rod 37 (FIG. 4) having a fork 38 at its upper end for enclosing the eccentric disk 17 and a slide block 39, which is guided in a slideway 40 of a pivot block 41 pivoted to the stand 6 (FIGS. 1 and 3), and which is provided with an adjusting lever 42 for regulating the stitch length.

As shown in FIG. 5, the sewing machine 1 described above is further provided with a presser foot 43 secured to a vertical shaft 44, a throat plate 45 and an edge guide 46 mounted on the throat plate 45 for guiding a first layer 47 to a second layer 48 of a workpiece 49. For joining together the two layers 47, 48 by means of a bead seam 50, the second layer 48 is provided with a protruding edge 51 in relation to the edge 52 of the first layer 47.

For forming the bead seam 50, there are provided an edge guide 46 with a forming edge 54 and a folding device 53, which is shown in FIGS. 21 to 24.

To the supporting arm 7 (FIGS. 21, 22) is secured a base plate 55 by means of screws 56. The edge guide 46 is fastened to the base plate 55 by means of screws 57. Two webs 58 span a clearance 59 located in the base plate 55 and are fastened to the latter by screw means 60. Between the two webs 58 there is pivotally mounted a slide block 61, which is received in a forked portion 62 of a carrier 63.

The carrier 63 is provided with bearings 64 for pivotally receiving a two-armed lever 66 by means of a pin 67. To one arm 68 of the two-armed lever 66 there is secured by means of a screw 70 a ruffling and folding finger 69, which protrudes the edge guide 46 and is provided with a plain underside 71 (FIGS. 23), a run-on edge 72 and a cutaway portion 73 in front and lateral of the needle 12. The second arm 74 of the two-armed lever 66 is received in guide blocks 75 of the carrier 63. In bores 76 located in the guide blocks 75, there is pivoted an adjusting means 77 consisting of an adjusting knob 78 having a bolt 79 for inserting into the bores 76, and a stop member 80 arranged between the guide blocks 75 and fastened to the bolt 79 by a pin 81 and having stop surfaces 82 to 85 of different distances to the turning center of the bolt 79. The end of the second arm 74 is pushed against one of the stop surfaces 82 to 85 of the stop member 80 by a spring 86, which is adjusted by an adjusting screw 87 provided with a nut 87*a* arranged in the carrier 63.

A vertical shaft 88 (FIGS. 2, 4, 21, 22) pivoted in the bracket arm 8 and the supporting arm 7 (FIG. 2), is in driven connection with the arm shaft 9 by means of a pair of bevel gears 89.

The carrier 63 is received at its hole 65 with play by an eccentric 90 secured by means of a set screw 92 to the vertical shaft 88. The eccentric 90 consists of an eccentric body 91 and a cover disk 94 fastened to the body 91 by means of two screws 93.

Figure 21:
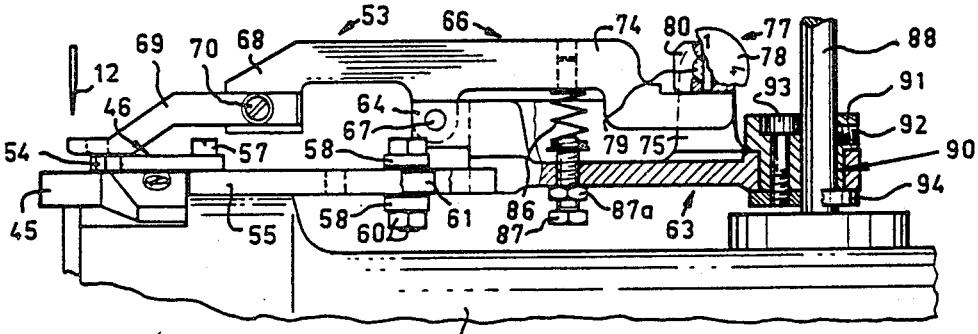
FIG. 21 shows a portion of the work supporting arm provided with a modified auxiliary ruffle and bead seam folding device, in a partial front view.
Figure 22:
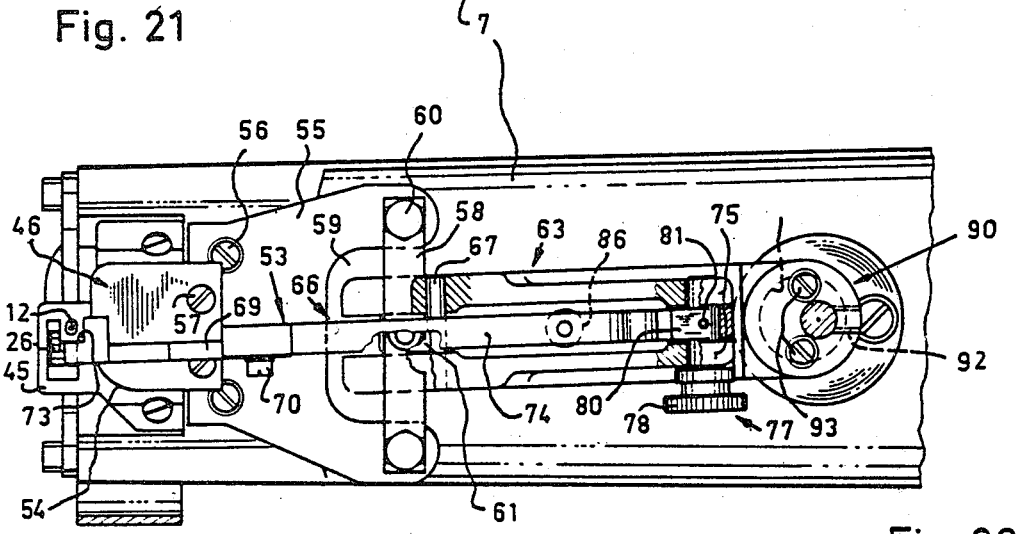
FIG. 22 is a top plan view of the work supporting arm corresponding to FIG. 21.
Figure 23:
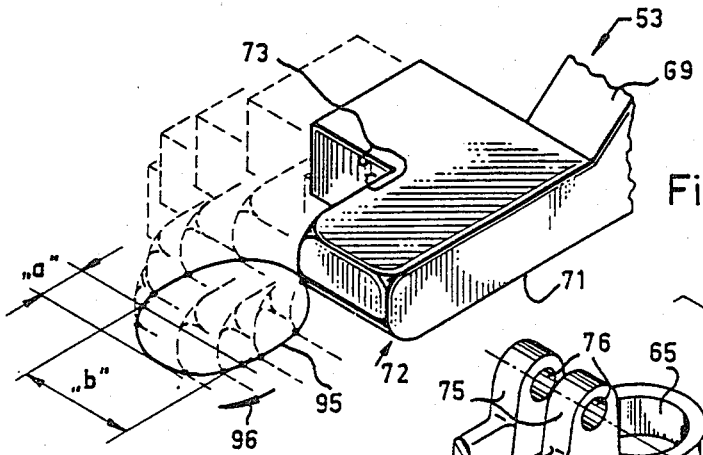
FIG. 23 shows in an enlarged representation a portion of the ruffle finger corresponding to FIG. 21 and the elliptical path of motion of this finger.

According to FIGS. 4, 5 and 21 to 24, operation of the sewing machine for sewing together a workpiece consisting of a first layer 47 and a second layer 48 having a protruding edge 51, can be described as follows:

The two layers 47 and 48 are positioned over one another with the edge 51 protruding over the first layer 47 (FIG. 5) and manually folded about the edge 52 of the first layer 47, and are guided along the edge guide 46 below the lifted presser foot 43 and the needle 12. According to the thickness of the layers to be sewn (first layer 47, second layer 48 and folded edge 51 of the second layer 48) the vertical position of the ruffling and folding finger 69 may be varied by turning the stop member 80 by means of the adjusting knob 78. After beginning of the stitch forming, the ruffling and folding finger 69 begins to move in an elliptical path 95 in the direction of arrow 96 (FIG. 23), at which the portion of the ellipse 95 indicated with "a" and "b" shows the effective range of the finger 69 after reaching the edge 51. By this, the run-on edge 72 causes a folding of the protruding edge 51 prefolded by the forming edge 54 of the edge guide 46 by means of the wiping of the finger 69 and about the edge 52 of the first layer 47 and with assistance of the lower feed dog 26 while feeding the workpiece 49 in feed direction by means of the finger 69, which is pressed down by the spring 86 (FIGS. 21, 22).

FIGS. 6 and 7 show a modified presser foot 97, the sole 98 of which is formed with an intermediate portion 99. The latter is located in front of the needle 12 and between the first layer 47 and the folded protruding edge 51 of the second layer 48 and promotes the final folding of the protruding edge 51 by the finger 69 prior to stitching.

Moreover, the sewing machine (FIGS. 2 to 4 and 10 to 13) is provided with an upper feed dog 100 moved in a four-motion-path and secured by a screw 102 to a swinging lever 101, which is pivoted at its upper end about a pin 103 (FIGS. 2 to 4) carried by a bracket 104). This bracket 104 is secured to a presser foot bar 105, which is slideably guided in the sewing head 10 and pushed down together with the swinging lever 101 and the upper feed dog 100 by means of a compression spring 106 (FIG. 4).

The presser foot bar 105 carries at its free end a fork guide 107, in which the swinging lever 101 is slideably guided and movable in the feed direction, and a second fork guide 108, to which is hinged one arm 109 of an angle lever 110 pivoted in the sewing head 10, while the other arm 111 carries a cam follower 112 for cooperating with a cam 113 located at the crank 13, in order to move the upper feed dog 100 in a vertical plane. By means of an adjusting device 114 (FIGS. 3, 4) consisting of an adjusting screw 115 screwed into the arm 111, the cam follower 113 linked to the arm 111, can be set more or less into the effective range of the cam 113.

For moving the upper feed dog 100 in a longitudinal direction, a rocket shaft 116 is pivotally carried in the bracket arm 8 and has an arm 117 with a roller 118, which engages a groove 119 of the cam plate 19. At the other end of the rocker shaft 116, there is secured a slotted lever 120, in which a slide block 121 is received. A connecting lever 122 is pivoted in the bracket arm 8, one arm 123 of which is formed as a fork 124 slideably engaging the swinging lever 101, while the other arm 125 is slotted for receiving a slide block 126, which is guided in a bar 127 and a bushing 128. The slide blocks 121 and 126 are connected by a connecting rod 129, which is under the tension of a tension spring 130, the free end of which is supported by the arm 125. The connecting rod 129 is linked by a chain 131 to a double-armed lever 132, which is pivotally mounted to the bracket arm 8 by a bolt 133 and may be actuated by a treadle 134 (FIG. 1) connected with a chain 135 to the double-armed lever 132.

A bolt 133 (FIG. 2) carries a lever 136, which is adjustably secured to the double-armed lever 132 by means of a screw 137. Linked to the lever 136 is a connecting rod 138 (FIGS. 2, 16, 17 and 20), which is provided with an oblong hole 139 and a projecting stop member 140 (FIGS. 17, 20).

On a shaft 141 situated in the supporting arm 7, there is clamped a control disk 142 and an adjusting knob 143 with a scale 144. The connecting rod 138 is slideably guided in the oblong hole 139 located at the shaft 141, between a washer 145 and the control disk 142 (FIG. 17), so that the stop member 140 bears against the control disk 142. The adjusting knob 143 serves for limiting the effecting range of the double-armed lever 132, which is operable by the treadle 134.

For lifting the upper feed dog 100 (FIGS. 2 and 3), there is pivotally mounted at the sewing head 10 a cam 146, which can engage the bracket 104 by means of a hand lever 147 (FIG. 1). An air cylinder 148 is pivotally mounted on the stand 6 and connected with a transmitting lever, the free end 150 of which can abut against a stud 149 of the arm 109 (FIG. 4).

In the preferred embodiment of a sewing machine for sewing together a vamp 151 and a plug 152 of a true moccasin shoe 154 by means of a beam seam 153 (FIG. 9), the sewing machine, as shown in FIGS. 4 and 16 to 19, further comprises an eccentric 155 and a cam disk 157, which are secured to the vertical shaft 88 by means of set screws 156 and 158.

Figure 24:
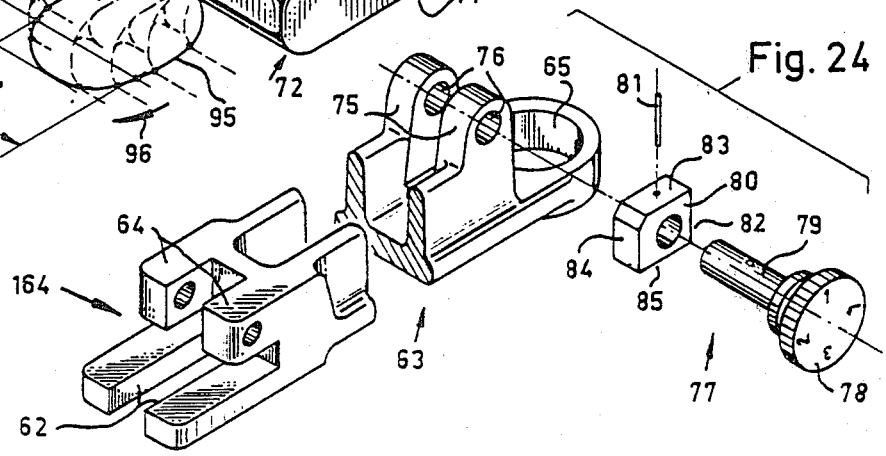
FIG. 24 is a perspective view of a carrier and parts of adjusting means for the ruffle finger.

A carrier 159 is provided with a hole 160 at its one end for receiving the eccentric 155, a bearing 162, in which a two-armed lever 163 is pivoted, and a forked portion at its free end similar as shown in FIG. 24 and indicated with 164. The fork 165 (FIGS. 4, 17) receives a slide block 166 pivotally arranged to a lever 167, which is hinged at a base plate 168 fastened by screws 172 to the supporting arm 7. The position of the lever 167 is adjustably secured in an oblong hole 169 by means of a threaded bolt 170 and a knurled nut 171.

One arm 173 of the two-armed lever 163 carries a ruffling finger 174 secured by a screw 175. The ruffling finger 174 (FIGS. 16, 17 and 19) is provided with teeth 176 arranged at the underside 177, and a cutaway portion 178 for clearing the path of the needle 12. The other arm 179 is guided in a lateral guidance 180 and provided with a cam follower 181, which abuts against the cam disk 157. A spring 182 is arranged between the two-armed lever 163 and an adjusting screw 183 located in the carrier 159 and secured by a lock nut 184.

At the supporting arm 6, there is mounted a bracket 185 by a screw 186 (FIGS. 2, 3, 10 to 14 and 16, 17), which carries an intermediate member 187 secured by screws 188 and terminating in front of the needle 12.

Referring to FIGS. 9 to 13 and 16, 17 and 19, the operation of the sewing machine for sewing together a vamp 151 and a plug 152 of a true moccasin shoe 154 by means of a bead seam 153 can be described as follows:

It may be assumed that the needle 12, the upper feed dog 100 and the ruffling finger 174, which is lifted for this purpose by a rod 190 mounted on the swinging lever 101 (FIG. 2), are in upper position: at first, the plug 152 is placed between the lower feed dog 26 and the intermediate member 187, so that the protruding edge 189 of the plug 152 is upwardly prefolded by the forming edge 54 of the edge guide 46. Then, the vamp 151 can be laid on the intermediate member 187 and under the upper feed dog 100. Prior to lowering of the upper feed dog 100 and the linked ruffling finger 174, the protruding edge 189 of the plug 152 must be folded manually about the edge 191 of the vamp 151, so that the ruffling finger 174 rests on the folded protruding edge 189. As the needle 12 moves downwardly and the lower feed dog 26 feeds the plug 152 towards the needle 12, the ruffling finger 174 runs on a tridimensional path 192 (FIG. 19) from "A" to "B", in order to cooperate not only with the feed dog 26 but to finally fold and positively feed and to hold down the protruding edge 189 until the needle 12 penetrates the workpiece parts.

Then, the ruffling finger 174 continues to run on the tridimensional path 192, which is caused by superposing the movements of the eccentric 155 and the cam disk 157 (FIGS. 4, 16). The effective range with the dimensions "x" and "y" may be varied by adjusting the lever 167, while the dimension "z" may be varied by adjusting the cam disk 157 axially.

As the length of a stitch may be set by the adjusting lever 42 (FIGS. 3 and 4) cooperating with the lower feed dog 26, the feed rate of the upper feed dog 100 acting upon the vamp 151 may be varied by pushing the treadle 134 (FIG. 1) for imparting longitudinal work compressing motions during operation. The basic feed rate of the upper feed dog 100 can be preselected by means of the adjusting knob 143 and the scale 144, while the arrangement of the treadle 134 allows an overriding to any value higher than preselected by the knob 143.

Similar, as already described in connection with FIGS. 6 and 7, the upper feed dog 193 shown in FIGS. 14 and 15, may also be provided with a second intermediate member 194, on the underside of which the teeth 195 extend, so that heavy materials can be processed easily and the wrinkles caused by the fullness of the vamp 151 are not stripped back by the protruding edge 181 of the plug 152. The sliding surface 196 of the second intermediate member 194 is polished and assists the ruffling and folding process.

Referring to FIGS. 25 to 28, a modified bead seam forming device 197 is illustrated, in which the ruffling finger and the edge guide of the aforesaid folding devices are replaced by a roller 198.

The roller 198 is shaped with a knurled semi-circular profile 199 (FIG. 27) and has a shaft 200, which is received in an overrunning element 201 and axially secured by means of a washer 202 and a retaining ring 203. The overrunning element 201 is received in an arm 204 mounted to one end 205 of a rocking lever 206, and fastened by means of a screw 207. The rocking arm 207 is pivotally received by a bolt 208 in bearings 209 located in a carrier 210, and laterally guided in guide blocks 211 of the carrier 210. The guide blocks 211 are provided with bearings 212 for receiving an adjusting means 213. The carrier 210 is pivoted about a bolt 214 secured by a collar 215 and received in a plate 216, which is fastened to the supporting arm 7 by screws 217. The free end 218 of the carrier 210 is linked to a link 219, which is received on an eccentric 220 secured to the vertical shaft 88 and having a cover disk 221 fastened by screws 222 to the eccentric 220.

The adjusting means 213 as well as an arrangement of an adjustable spring 223 forcing the rocking lever 206 to push down the roller 198 against the workpiece layers are similarly formed as shown in FIGS. 21 to 24.

The operation of the bead seam forming device described above in connection with FIGS. 25 to 28 can be described as follows:

During the rotation of the vertical shaft 88, the carrier 210 performs swinging movements about the bolt 214, so that the rocking lever 206 moves the roller 198 in synchronism with the needle 12. As the needle 12 penetrates the workpiece and performs a stitch on its way to the needle-up-position, the roller 198 will be moved in direction "R" (FIG. 28) and prefolds, while rotating about its shaft 200, the protruding edge 189 of the plug 152 (FIG. 9). When the needle 12 moves downward, the roller 198 moves without rotation in feed direction "V" caused by the overrunning element 201 and imparts work-compressing and -feeding motions in cooperation with the lower feed dog 26. The semi-circular profile 199 of the roller 198 serves an an edge guide, as the knurling acts like a toothed portion and assists the step motion of the roller 198 for prefolding and ruffling.

Finally, a further embodiment of a bead seam forming device is illustrated in FIGS. 29 to 35.

On the vertical shaft 88 there is pivotally arranged a carrier 224 axially secured by a collar 225, and an eccentric 226 fastened by a set screw 227. The carrier 224 is provided with bearings 228 for receiving a rod 229 secured to it by a set screw 230, and formed with a recess 231 as well as a lateral guidance 232 for guiding a slide member 233. The slide member 233 is movably received within the recess 231 and guided on the rod 229 and between the lateral guidance 232, and is further provided with a bolt 234 fastened by a set screw 235. A link 236 is linked to the slide member 233 by means of a bolt 234 and received at the free end of the eccentric 226. The latter is covered by a disk 237, which is disposed between the eccentric 226 and the carrier 224 and rotatably secured by a pin 238. To the free end of the carrier 224 there is fastened by screws 240 a transmitting plate 239, which is guided in a vertical direction within a bridge 241 secured to a guide plate 242 and the supporting arm 7 by means of screws 243.

Between the transmitting plate 239 (FIG. 31) and the feed dog carrier 24 (FIG. 35) there is situated a coupling member 244, which comprises a cylindrical member 245 slidably received in a longitudinal bore 246 of an extension 247 arranged at the feed dog carrier 24 (FIG. 35). A cylindrical drive bolt 267, (FIG. 33) fastened to the transmitting plate 239, is movable with clearance within a vertical bore 248 of the extension 247 and guided in a radial bolt hole 249 (FIG. 35) of the cylindrical member 245. The extension 247 of the feed dog carrier 24 is guided within a recess 262 (FIG. 30) located in the guide plate 242, which is secured to the supporting arm 7 by means of screws 250. The feed dog 26 is secured to the feed dog carrier 24 by a screw 27 and provided with a mounting surface 263 (FIG. 35) for receiving an edge guiding member 252, which is attached by means of a screw 261 and formed with a forming wall 253 and a recess 254. The feed dog 26 with the edge guiding member 252 may be moved within a recess 251 of the throat plate 45.

The sliding member 233 carries a rocking lever 256 (FIGS. 29 to 32) pivoted by a bolt 264. The one lever end 258 is formed with a stop portion 257, which bears against an adjusting device 259 by means of a spring 260 arranged between the sliding member 233 and the lever end 258 (FIG. 29). The free end of the rocking lever 256 carries a folding finger 255 by means of a screw 265. The front portion 266 of the folding finger 255 ends in the recess 254 of the edge guiding member 252 (FIG. 34).

The bead seam forming device as described above works as follows:

The eccentric 226 (FIG. 29) imparts reciprocating movements to the slide member 233 and thus also to the folding finger 255 respectively the front portion 266. These movements are imparted perpendicularly to the feed direction of the workpieces and are superposed by longitudinal work compressing motions imparted by the feed dog carrier 24 via the coupling member 244 to the carrier 224 pivoted about the vertical shaft 88.

As the workpiece parts are fed by the feed dog 26 (FIG. 34) towards the needle 12, the forming wall 253 prefolds the protruding edge 189 of the plug 151 (FIG. 9) by vertical and feed motions, while the front portion 266 of the folding finger 255 finally folds, ruffles and wipes the protruding edge 181 in cooperation with the upper feed dog 193 and its second intermediate member 194 (FIG. 15) to a bead shape, prior to the stitching process. Depending on the thickness of the workpiece parts, the initial vertical position of the folding finger 255 may be varied by means of the adjusting device 259, thus effecting the wiping and ruffling action. Since the feed dog 26 is linked by means of the coupling member 244 to the bead forming device, a variation of the stitch length by means of the adjusting lever 42 (FIGS. 1 and 3) also effects the movements of the bead forming tools, i.e. forming wall 253 and front portion 266 of the folding finger 255.

While the devices described above and illustrated in the drawings relate to the sewing together of workpiece parts by means of a bead seam, it is also possible to sew together two workpiece parts by means of an open edge seam, as, for example, shown in FIG. 8, an open edge ruffling seam of a true moccasin shoe.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What we claim is:

1. A sewing machine for sewing a workpiece consisting of a first layer having a relative long edge and a second layer having a relative short protruding edge, comprising: stitch forming means including a needle and a looptaker mechanism; feeding means for said second layer; feeding means for imparting longitudinal work compressing motions to said first layer; an intermediate member arranged in front of said needle and between said first layer and said second layer for preventing a ruffling of said second layer by said feeding means for said first layer; an edge guide for said layers; and means for forming said protruding edge of said second layer to a bead seam and comprising a forming edge at said edge guide for prefolding said protruding edge of said second layer, and a driven auxiliary ruffling means arranged in front of said needle for folding said prefolded protruding edge of said second layer about the edge of said first layer and imparting longitudinal work compressing motions to said folded protruding edge of said second layer.

2. A sewing machine according to claim 1, further comprising: adjusting means for said feeding means for said second layer for regulating the stitch length; adjusting means for said feeding means for imparting longitudinal work compressing motions to said first layer for varying the rate of ruffling during sewing; a second intermediate member arranged between said first layer and said folded protruding edge of said second layer and in front of said needle; and driving means for moving said auxiliary ruffling means in synchronism with said needle.

3. In a machine for sewing together a vamp and a plug having a protruding edge provided for forming a bead seam on a moccasin-type shoe comprising: stitch forming means including a needle and a looptaker mechanism, an edge guide for guiding said vamp and said plug and prefolding said protruding edge of said plug, feeding means for said plug, adjusting means for said feeding means for said plug for determining stitch length, feeding means for imparting longitudinal work compressing motions to said vamp, means for adjusting longitudinal motions of said feeding means for said vamp, and an intermediate member between said feeding means for said plug and said feeding means for said vamp for preventing ruffling of said plug by said feeding means for said vamp; a driven auxiliary ruffling means arranged in front of said needle for folding said prefolded protruding edge of said plug about the edge of said vamp and imparting longitudinal work compressing motions to said folded edge of said plug.

4. A machine according to claim 3, further comprising: a second intermediate member arranged between said vamp and said folded protruding edge of said plug and in front of said needle.

5. A machine according to claim 3, wherein said feeding means for imparting longitudinal work compressing motions to said vamp includes: a feed dog operating in a four motion path adjacent and opposite to said needle and said edge guide and having a second intermediate member with a sliding surface and arranged between said vamp and said folded protruding edge of said plug and in front of said needle; and teeth in said feed dog and said second intermediate member for engaging said vamp.

6. A machine according to claim 3, wherein said auxiliary ruffling means for folding said prefolded protruding edge of said plug about the edge of said vamp and imparting longitudinal work compressing motions to said folded edge of said plug comprises: a ruffle finger provided with teeth arranged at the underside of said finger and perpendicular to the feed direction of said vamp and said plug and having a cutaway portion for said needle; and a control mechanism for imparting tridimensional ellipse-shaped motions to said ruffle finger in synchronism with movement of said needle.

7. A machine as claimed in claim 6, further comprising: a housing including a standard, a work supporting arm extending from said standard and a bracket arm carrying an arm shaft and ending in a sewing head; said control mechanism for imparting tridimensional ellipse-shaped motions to said ruffle finger in synchronism with the movement of said needle including: a two-armed lever having one arm carrying said ruffle finger; a vertical shaft pivoted in said work supporting arm and said bracket arm and in driving connection with said arm shaft; an eccentric secured to said vertical shaft; a carrier having a bearing for receiving said two-armed lever, a hole at one end of said carrier for receiving said eccentric imparting ellipse-shaped motions to said ruffle finger, and pivotal means at the other end of said carrier; a cam follower arranged on the other arm of said two-armed lever; a cam disk cooperating with said cam follower for imparting up and down motions to said ruffle finger; and spring means between said carrier and said other arm of said two-armed lever for pressing down said ruffle finger in the direction to said protruding edge of said plug.

8. A sewing machine as claimed in claim 7, wherein said pivotal means of said carrier comprises: a forked portion at the end of said carrier; a slide block received in said forked portion; means for shifting said slide block within said forked portion of said carrier and including a lever pivoted to said work supporting arm, means for pivoting said slide block to said lever, and adjusting means for said lever and said slide block for varying the elliptical path of motion of said ruffle finger.

9. A machine as claimed in claim 3, further comprising: a housing including a standard, a work supporting arm extending from said standard and a bracket arm carrying an arm shaft and ending in a sewing head; said auxiliary ruffling means arranged to operate in front of said needle comprising: a ruffling and folding finger having a plain underside, a run-on edge in feed direction, and a cutaway portion for said needle; a control mechanism for imparting ellipse-shaped motions to said ruffling and folding finger in synchronism with movement of said needle and including a two-armed lever having one arm carrying said ruffling and folding finger, a vertical shaft pivoted in said work supporting arm and said bracket arm and in driving connection with said arm shaft, an eccentric secured to said vertical shaft, a carrier provided with a bearing for receiving said two-armed lever, a hole at one end of said carrier for receiving said eccentric imparting ellipse-shaped motions to said ruffling and folding finger, and pivotal means at the other end of said carrier; spring means between said carrier and the second arm of the two-armed lever for pressing down said ruffling and folding finger in the direction to said protruding edge of said plug; and adjusting means for varying the position in vertical sense of said ruffling and folding finger.

10. A machine according to claim 9, wherein said spring means between said carrier and the other arm of said two-armed lever comprises: a coil spring; and an adjusting screw for varying the tension of said coil spring.

11. In a machine for sewing together true moccasin shoe parts including a vamp and a plug, comprising: a housing including a stand, a work supporting arm extending from said stand, a bracket arm carrying an arm shaft and ending in a sewing head; lockstitch forming means including a needle and a barrel shuttle; a toothed feed dog cooperating with said plug; adjusting means for said feed dog cooperating with said plug for determining the stitch length; an upper feed dog operating in a four motion path adjacent and opposite to said needle and having a toothed base for imparting longitudinal work compressing motions to said vamp; means for adjusting the longitudinal work compressing motions of said upper feed dog; and an intermediate member arranged between said feed dog for said plug and said upper feed dog and in front of the path of motion of said needle for preventing a ruffling of said plug by said upper feed dog; means for forming a bead seam by means of a plug having a foldable margin protruding the edge of said vamp and comprising: a second intermediate member attached to said upper feed dog and having a sliding surface and toothed at the base like said upper feed dog and located between said vamp and said folded margin of said plug and in front of the path of said needle; an edge guide having a forming edge for prefolding said margin of said plug; auxiliary ruffling means for folding said prefolded margin of said plug about the edge of said vamp and said second intermediate member and including a ruffle finger with teeth arranged at the base of said finger and perpendicular to the feed direction and having a cutaway portion for said needle, a two-armed lever with one arm carrying said ruffle finger; a vertical shaft pivoted in said work supporting arm and said bracket arm and in driving connection with said arm shaft; an eccentric secured to said vertical shaft; a carrier provided with a bearing for receiving said two-armed lever, a hole at one end of said carrier for receiving said eccentric imparting ellipse-shaped motions to said ruffle finger, and pivotal means at the other end of said carrier; a cam follower arranged on the other arm of said two-armed lever; a cam disk cooperating with said cam follower for imparting up and down motions to said ruffle finger; spring means between said carrier and said other arm of said two-armed lever for pressing down said ruffle finger in the direction to the folded margin of said plug; and adjusting means for varying the tension of said spring means.

12. In a machine for sewing together a vamp and a plug of true moccasin footwear, comprising: a work supporting arm; a bracket arm; stitch forming means including a needle, an arm shaft pivoted in said bracket arm for driving said needle, and a looptaker; a throat plate; a lower feed dog; a feed dog carrier for receiving and moving said feed dog in a four motion path within a recess of said throat plate; an upper feed dog operating in a four motion path adjacent and opposite to said needle and having a toothed base for imparting longitudinal work compressing motions to said vamp; and an intermediate member arranged between said plug and said vamp and in front of the path of motion of said needle for preventing a ruffling of said plug by said upper feed dog; means for forming a bead seam by said plug having a foldable margin protruding over the edge of said vamp and including: an edge guiding member secured to said upper feed dog and having a forming wall for prefolding said margin of said plug and surmounting said throat plate and a recess in said forming wall; a second intermediate member attached to said upper feed dog and having a sliding surface and being toothed at the base like said upper feed dog, and located between said vamp and said folded margin of said plug and in front of said needle; a folding and ruffling finger for folding said prefolded margin of said plug about the edge of said vamp and said second intermediate member, and slideably received in said recess of said forming wall; first driving means for said folding and ruffling finger for imparting movements in feed direction; and second driving means imparting movements perpendicular to the feed direction to said finger for finally folding said prefolded protruding edge of said plug.

13. A machine as claimed in claim 12, further comprising: a vertical shaft pivoted in said supporting arm and said bracket arm and in driving connection with a rotatably driven shaft of said machine; said first and second driving means including: a carrier having a recess, a lateral guidance and bearings and pivoted to said vertical shaft; a rod received in and secured to said bearings; a transmitting plate secured to the free end of said carrier; a coupling member between said transmitting plate and said feed dog carrier for moving said carrier having a recess about said vertical shaft corresponding to the movement of said feed dog; a slide member slideably received on said rod and movable within said recess and guided between said lateral guidance of said carrier; an eccentric secured to said vertical shaft; a link on said eccentric and linked to said slide member for moving said member vertically to the path of motion of said feed dog; a rocking lever pivoted to said slide member and carrying said folding and ruffling finger slideably received in said recess of said wall of said edge guiding member, and having a stop portion at the other end; an adjusting device on said slide member cooperating with said stop portion of said rocking lever for varying the effectiveness of said finger corresponding to the thickness of the workpiece to be sewn together; and a spring between said rocking lever and said slide member for imparting pressure to said margin.

14. A sewing machine as claimed in claim 13, wherein said coupling member comprises: an extension formed at said feed dog carrier and having a longitudinal bore and a vertical bore; a cylindrical member slideably received in said longitudinal bore and having a radial bolt hole; and a cylindrical drive bolt secured to said transmitting plate and slideably guided in said radial bolt hole of said cylindrical member and surrounded with clearance by said vertical bore of said extension.

* * * * *